252-99 AU 166 EX
9/26/78 XR 4,116,852

United States Patent [19]
Bailey et al.
[11] 4,116,852
[45] Sep. 26, 1978

[54] BUILDERS AND BUILT DETERGENT COMPOSITIONS

[75] Inventors: John Bailey, Ryton; Michael John Randell; Paul Richard Sherrington, both of Newcastle upon Tyne, all of England

[73] Assignee: The Procter & Gamble Company, Cincinnati, Ohio

[21] Appl. No.: 828,111

[22] Filed: Aug. 24, 1977

Related U.S. Application Data

[63] Continuation of Ser. No. 657,655, Feb. 12, 1976, abandoned.

[30] Foreign Application Priority Data

Feb. 14, 1975 [GB] United Kingdom ..... 6357/75

[51] Int. Cl.² ..... C11D 3/06; C11D 7/16
[52] U.S. Cl. ..... 252/135; 252/99; 252/531; 252/539
[58] Field of Search ..... 252/135, 531, 99, 539

[56] References Cited

U.S. PATENT DOCUMENTS

| | | | |
|---|---|---|---|
| 2,941,947 | 6/1960 | Schauer | 252/135 |
| 3,198,740 | 8/1965 | Dunlop et al. | 252/135 |
| 3,639,287 | 2/1972 | Gabler et al. | 252/135 |
| 3,925,262 | 12/1975 | Laughlin et al. | 252/135 |

FOREIGN PATENT DOCUMENTS 2,422,655 11/1974 Fed. Rep. of Germany.

*Primary Examiner*—Mayer Weinblatt

[57] ABSTRACT

Detergent compositions utilizing alkali metal pyrophosphate as the principal detergency builder incorporate a phosphate builder mixture comprising from about 1% to about 15% by weight of the mixture of tripoly — and higher polymeric phosphates and not more than 1% by weight of the mixture of orthophosphates. Other types of builders both soluble and insoluble can also be present.

9 Claims, No Drawings

BUILDERS AND BUILT DETERGENT COMPOSITIONS

CROSS-REFERENCE

This application is a continuation of co-pending U.S. application Ser. No. 657,655, filed Feb. 12, 1976, now abandoned.

FIELD OF THE INVENTION

The invention relates to a detergency builder composition consisting predominantly of pyrophosphate and detergent compositions containing it.

BACKGROUND OF THE INVENTION

For many years the primary material used to control water hardness in detergent products has been sodium tripolyphosphate at levels of approximately 50% by weight of the finished detergent product. Within the past few years the use of high levels of sodium tripolyphosphate has come under scrutiny because of the suspicion that soluble phosphate species accelerate the euthrophication or aging process of water bodies. This eutrophication is ordinarily evidenced by the rapid growth of algae in the water body. Sodium tripolyphosphate exists as a molecule containing 5 atoms of sodium, 3 of phosphorus, and 10 atoms of oxygen. When utilized as a detergent builder the sodium tripolyphosphate molecule sequesters as a soluble species one molecule of calcium or magnesium cations per molecule of tripolyphosphate anion. In other words, sodium tripolyphosphate sequesters calcium and magnesium ions on a 1:1 mole basis. The calcium or magnesium tripolyphosphate species is relatively stable in a wash solution, thus preventing the water hardness from reacting with anionic detergents which in turn gives better cleaning. The calcium or magnesium tripolyphosphate species exists essentially as a single trivalent negative anionic species in the wash solution. This calcium or magnesium trivalent anion does not precipitate in the course of the wash. Sodium pyrophosphate has generally been considered to be an equivalent builder when compared to sodium tripolyphosphate. It has also been suspected that sodium pyrophosphate is the equivalent of sodium tripolyphosphate in promoting the eutrophication as has been discussed above.

Sodium pyrophosphate contains one less atom of phosphorus than does sodium tripolyphosphate. The foregoing is reflected in the empirical formula of sodium pyrophosphate which is 4 atoms of sodium, 2 atoms of phosphorus and 7 atoms of oxygen. Sodium pyrophosphate is also known to form a 1:1 molar complex with calcium or magnesium ions. The species resulting from the sequestration of calcium or magnesium by the tetravalent negative pyrophosphate anion in the calcium or magnesium divalent negatively charged pyrophosphate complex. This calcium or magnesium pyrophosphate complex is sufficiently stable in the wash solution to prevent the water hardness cations from interfering with the detergency process.

Aside from a molecular weight advantage which allows more moles of the pyrophosphate salt to be present in a composition at a given weight fraction of phosphate than tripolyphosphate, there would appear to be little difference between using pyrophosphates and tripolyphosphate in detergent products. However, such is not the case, one curious difference exists between the pyrophosphate anion and the tripolyphosphate anion and that is the ability of the former to precipitate as the dicalcium pyrophosphate salt under normal wash conditions. The precipitation of pyrophosphates has been sought to be avoided in wash solutions as the salt formed has a tendency to build up on fabrics and exposed machine surfaces.

Furthermore the precipitation of calcium pyrophosphate is unpredictable under normal wash conditions where such factors as the total hardness, the pH, and the ratio of calcium ions to magnesium ions may vary from load to load.

Johnson states in U.S. Pat. No. 2,381,960 issued Aug. 14, 1945 that water-hardness may be reduced by adding pyrophosphates to the solution containing the hardness after a supplemental alkaline material such as sodium orthophosphate, alkali metal hydroxides and carbonates, soap and sodium silicate having an $SiO_2$:$Na_2O$ ratio greater than 1.5 have been added to the solution. Kepfer in U.S. Pat. No. 2,326,950 issued Aug. 17, 1943, discloses that pyrophosphates can be used to control water hardness if the pyrophosphate is added to the solution containing the hardness prior to the addition of supplemental alkaline materials such as sodium borate, sodium metasilicate and disodium dihydrogen phosphate. In both Johnson, supra, and Kepfer the second component (Johnson-pyrophosphate and Kepfer-supplemental alkaline material) is to be added to the solution prior to the formation of a macroscopic precipitate.

It can thus be seen that pyrophosphate has the potential of being a much more effective detergency builder than have the tripolyphosphate salts. The pyrophosphate tetravalent anion has a high association constant with the first calcium ion with which it associates. This first association product is the monocalcium pyrophosphate divalent anion. The divalent anion has a very small association constant with the second calcium ion to form the dicalcium pyrophosphate salt which is electrically neutral. In the absence of any material which makes the dicalcium pyrophosphate more stable one of the associated calcium ions will be free of disassociate and to seek a more stable association such as with body soil on the fabrics or with the anionic detergent. The main purpose of controlling calcium ions whether free or associated in a weak complex is to prevent the last mentioned reaction with the detergent or soiled fabric from occurring. As the pyrophosphate anion strongly holds one mole of calcium ion per pyrophosphate anion it has been common practice to attempt the first association (sequestration) on a mole for mole basis. If, however, the pyrophosphate anion can be induced to strongly associate (precipitate) with two moles of calcium ion the pyrophosphate level used could be reduced substantially. Preferably some free pyrophosphate tetravalent anion will be present in the wash for its value in peptizing clay soils.

It has been discovered as disclosed in commonly assigned copending U.S. application Ser. No. 618,303 by R. W. Benson, S. D. Cherney and E. J. Collier filed on Sept. 29, 1975 and incorporated herein by reference, that alkali metal pyrophosphates can be formulated into a detergent composition in a manner such that the pyrophosphate builds by first associating with and then precipitating up to two moles of calcium per mole of pyrophosphate. However, it has long been the experience of those skilled in the art that pyrophosphates have not been very effective for whiteness maintenance. Good 'whiteness maintenance' results from the ability of a detergent composition to prevent dirt dispersed in a wash liquor, for instance having been washed out of soiled articles, from being re-deposited upon clean or cleaned articles.

SUMMARY OF THE INVENTION

The invention provides builder compositions consisting predominantly of pyrophosphate, and detergent compositions containing them, which give improved whiteness maintenance.

According to the invention there is provided a detergency builder comprising water soluble alkali metal phosphates comprising pyrophosphates, tripoly or higher phosphates and orthophosphates, the proportion of tripoly or higher phosphates being from 1 to 15%, and the proportion of orthophosphates less than 1% by weight of the total phosphates. More particularly the invention provides a detergent composition comprising (a) from 1% to 50% of an organic anionic, nonionic, ampholytic or zwitterionic detergent or mixture of any of these;

(b) from 5% to 60% of phosphate detergency builder as described above.

DETAILED DESCRIPTION OF THE INVENTION

The pyrophosphate salts of the compositions of the present invention have alkali metal cations, such as sodium or potassium, preferably sodium. Pyrophosphate salts useful herein may be obtained commercially or may be formed by neutralization of the corresponding phosphoric acid or the acid salt.

As a general rule, the level of these phosphates in the detergent compositions can be as low as about half the level of tripolyphosphate which would formerly have been employed. The lowest levels can be obtained by use of the methods disclosed below. Some compositions especially intended for use in the prewash stage in the wash cycle of a modern automatic washing machine have contained up to about 70% sodium tripolyphosphate. Other heavy duty detergents contain only about 20%. Thus the preferred level of the phosphate mixture of the invention is from about 12% to about 45% by weight of the composition.

The proportion of tripolyphosphate (preferred) or of higher polyphosphates, is preferably from about 5 to about 12% by weight of the total phosphates. Levels above about 15% serve no further purpose in improving whiteness maintenance, and, in that tripolyphosphate is less efficient weight for weight than pyrophosphate in aiding cleaning as indicated above, higher levels are undesirable.

It is important that the content of orthophosphates be very low. As little as 1% orthophosphate by weight of the total phosphates is beginning to be harmful, and it is preferred that less than ½% by weight be present.

Generally it is preferred that the detergent compositions be so formulated that they have pH in the range 9–12, more preferably 9.8 to 11, in 1% aqueous solution. This means that usually the phosphates will be present in fully neutralized form i.e. tetrasodium pyro- and penta-sodium tripolyphosphate, but the acid forms may be employed if appropriate. Their state of hydration is immaterial for the purposes of the invention. The other components of the invention can be any which are used in detergent compositions.

A principal component of such compositions is an organic surfactant which may be anionic, nonionic ampholytic and zwitterionic or any mixture of these. One class of anionic surfactants of value in the present invention are the water soluble salts of alkyl ether sulphuric acids.

An especially preferred alkyl ether sulfate detergent component of the present invention is a mixture of alkyl ether sulfates, said mixture having an average (arithmetic mean) carbon chain length within the range of about 12 to 16 carbon atoms, preferably from about 14 to 15 carbon atoms, and an average (arithmetic mean) degree of ethoxylation of from about 1 to 4 moles of ethylene oxide, preferably from about 2 to 3 moles of ethylene oxide. Specifically, such preferred mixtures comprise from about 0 to 10% by weight of mixture of $C_{12-13}$ compounds, from about 50 to 100% by weight of mixture of $C_{14-15}$ compounds, and from about 0 to 45% by weight of mixture of $C_{16-17}$ compounds, and from about 0 to 10% by weight of a mixture of $C_{18-19}$ compounds. Further, such preferred alkyl ether sulfate mixtures comprise from about 0 to 30% by weight of mixture of compounds having a degree of ethoxylation of 0, from about 45 to 95% by weight of mixture of compounds having a degree of ethoxylation from 1 to 4, from about 5 to 25% by weight of mixture of compounds having a degree of ethoxylation from 5 to 8, and from about 0 to 15% by weight of mixture of compounds having a degree of ethoxylation greater than 8. The sulfated condensation products of ethoxylated alcohols of 8 to 24 alkyl carbons and with from 1 to 30, preferably 1 to 4 moles of ethylene oxide may be used in place of the preferred alkyl ether sulfates discussed above.

Another class of detergents which may be used in the present invention includes the water-soluble salts, particularly the alkali metal, ammonium, and alkylolammonium salts of organic sulfuric reaction products having in their molecular structure an alkyl group containing from about 8 to about 22 carbon atoms and a sulfuric acid ester group. Examples of this group of synthetic detergents are the sodium and potassium alkyl sulfates, especially those obtained by sulfating the higher alcohols ($C_8$–$C_{18}$ carbon atoms) produced by reducing the glycerides of tallow or coconut oil.

Preferred water-soluble organic detergent compounds herein include alkyl benzene sulfonates (preferably essentially linear although 'hard' ABS may be used) containing from about 9 to 15 carbon atoms in the alkyl group. Examples of the above are sodium and potassium alkyl benzene sulfonates in which the alkyl group contains from about 11 to about 13 carbon atoms, in straight chain or branched chain configuration, e.g. those of the type described in U.S. Pat. Nos. 2,220,099 and 2,477,383. Especially valuable are straight chain alkyl benzene sulfonates in which the average of the alkyl groups is about 11.2 carbon atoms, abbreviated as $C_{11.2}$LAS.

Another useful detergent compound herein includes the water-soluble salts of esters of a-sulfonated fatty acids containing from about 6 to 20 carbon atoms in the fatty acid group and their esters from about 1 to 14 carbon atoms in the alcohol radical. Preferred 'olefin sulfonate' detergent mixtures utilizable herein comprise olefin sulfonates containing from about 10 to about 24 carbon atoms. Such materials can be produced by sulfonation of a-olefins by means of uncomplexed sulfur trioxide followed by neutralization under conditions such that any sultones present are hydrolyzed to the corresponding hydroxy-alkane sulfonates. The a-olefin starting materials preferably have from 14 to 16 carbon atoms. Said preferred a-olefin sulfonates are described in U.S. Pat. No. 3,332,880, incorporated herein by reference. The paraffin sulfonates embraced in the present invention are essentially linear and contain from 8 to 24 carbon atoms, preferably 12 to 20 and more preferably 14 to 18 carbon atoms in the alkyl radical.

Other anionic detergent compounds herein include the sodium alkyl glyceryl ether sulfates, especially those ethers of higher alcohols derived from tallow and coconut oil; sodium coconut oil fatty acid monoglyceride sulfonates and sulfates; and sodium or potassium salts of alkyl phenol ethylene oxide ether sulfate containing about 1 to about 10 units of ethylene oxide per molecule and wherein the alkyl groups contain about 8 to about 12 carbon atoms.

Water-soluble salts of the higher fatty acids, i.e. 'soaps', are useful as the detergent component of the composition herein. This class of detergents includes ordinary alkali metal soaps such as the sodium, potassium, ammonium and alkylolammonium salts of higher fatty acids containing from about 8 to about 24 carbon atoms and preferably from about 10 to about 20 carbon atoms. Soaps can be made by direct saponification of fats and oils or by the neutralization of free fatty acids. Particularly useful are the sodium and potassium salts of the mixtures of fatty acids derived from coconut oil and tallow, i.e. sodium or potassium tallow and coconut soap.

Water-soluble nonionic synthetic detergents are also useful as the detergent component of the instant composition. Such nonionic detergent materials can be broadly defined as compounds produced by the condensation of alkylene oxide groups (hydrophilic in nature) with an organic hydrophobic compound, which may be aliphatic or alkyl aromatic in nature. The length of the polyoxyalkylene group which is condensed with any particular hydrophobic group can be readily adjusted to yield a water-soluble compound having the desired degree of balance between hydrophilic and hydrophobic elements.

For example, a well-known class of nonionic synthetic detergents is made available on the market under the trade name 'Pluronic' sold by Wyandotte Chemicals. These compounds are formed by condensing ethylene oxide with a hydrophobic base formed by the condensation of propylene oxide with propylene glycol. Other suitable nonionic synthetic detergents include the polyethylene oxide condensates of alkyl phenols, e.g. the condensation products of alkyl phenols having an alkyl group containing from about 6 to 12 carbon atoms in either a straight chain or branched chain configuration, with ethylene oxide, the said ethylene oxide being present in amounts equal to 5 to 25 moles of ethylene oxide per mole of alkyl phenol.

The water-soluble condensation products of aliphatic alcohols having from 8 to 22 carbon atoms, in either straight chain or branched configuration, with ethylene oxide, e.g. a coconut alcohol-ethylene oxide condensate having from 5 to 30 moles of ethylene oxide per mole of coconut alcohol, the coconut alcohol fraction having from 10 to 14 carbon atoms, are also useful nonionic detergents herein.

Semi-polar nonionic detergents include water-soluble amine oxides containing one alkyl moiety of from about 10 to 28 carbon atoms and 2 moieties selected from the group consisting of alkyl groups and hydroxyalkyl groups containing from 1 to about 3 carbon atoms; water-soluble phosphine oxide detergents containing one alkyl moiety of about 10 to 28 carbon atoms and 2 moieties selected from the group consisting of alkyl groups and hydroxyalkyl groups containing from about 1 to 3 carbon atoms; and water-soluble sulfoxide detergents containing one alkyl moiety of from about 10 to 28 carbon atoms and a moiety selected from the group consisting of alkyl and hydroxyalkyl moieties of from 1 to 3 carbon atoms.

Ampholytic detergents include derivatives of aliphatic or aliphatic derivatives of heterocyclic secondary and tertiary amines in which the aliphatic moiety can be straight chain or branched and wherein one of the aliphatic substituents contains from about 8 to 18 carbon atoms and at least one aliphatic substituent contains an anionic water-solubilizing group. Zwitterionic detergents include derivatives of aliphatic quaternary ammonium, phosphonium and sulfonium compounds in which the aliphatic moieties can be straight chain or branched, and wherein one of the aliphatic substituents contains from about 8 to 18 carbon atoms and one contains an anionic water-solubilizing group.

Other useful detergents include water-soluble salts of 2-acyloxy-alkane-1-sulfonic acids containing from about 2 to 9 carbon atoms in the acyl group and from about 9 to about 23 carbon atoms in the alkane moiety; β-alkyloxy alkane sulfonates containing from about 1 to 3 carbon atoms in the alkyl group and from about 8 to 20 carbon atoms in the alkane moiety; alkyl dimethyl amine oxides wherein the alkyl group contains from about 11 to 16 carbon atoms; alkyldimethyl-ammonio-propane-sulfonates and alkyl-dimethylammonio-hydroxy-propane-sulfonates wherein the alkyl group in both types contains from about 14 to 18 carbon atoms; soaps as hereinabove defined; the condensation product of tallow fatty alcohol with about 11 moles of ethylene oxide; the condensation product of a $C_{13}$ (avg.) secondary alcohol with 9 moles of ethylene oxide; and alkyl glyceral ether sulfates with from 10 to 18 carbon atoms in the alkyl radical.

A typical listing of the classes and species of detergent compounds useful herein appear in U.S. Pat. No. 3,852,211, to Ohren issued Dec. 3, 1974, incorporated herein by reference. The foregoing list of detergent compounds and mixtures which can be used in the instant compositions is representative of such materials, but is not intended to be limiting.

A particularly useful anionic detergent mixture comprises:

(i) from about 2% to about 15% by weight of an alkyl sulfate wherein the alkyl radical has from 10 to 20 carbon atoms and mixtures thereof the cation being an alkali metal preferably sodium;

(ii) from about 2% to about 15% by weight of an alkyl benzene sulfonate having from 9 to 15 carbon atoms in the alkyl radical and mixtures thereof, the cation being an alkali metal preferably sodium. An additional component which may be added to (i) and (ii) above is:

(iii) from about 2% to about 15% by weight of an alkyl ethoxy sulfate having from 10 to 20 carbon atoms in the alkyl radical and from 1 to 30 ethoxy groups and mixtures thereof having an alkali metal preferably sodium cation.

The detergent is present in the detergent composition at levels of about 1% to 50%, preferably from about 5% to about 40%, and most preferably from about 10% to about 30% by weight.

Another very useful mixture of detergents comprises nonionic and zwitterionic agents, for instance sulphobetaines with a $C_{8-18}$ aliphatic radical and surfactant polyethoxy alcohols.

The detergent compositions may, and preferably do, also contain an alkali metal silicate having the formula $SiO_2:M_2O$ wherein M is an alkali metal or mixtures thereof, such as the sodium or potassium salt, preferably sodium. The weight ratio $SiO_2:M_2O$ is from about 1.6:1 to about 4:1, preferably from about 2.4:1 to about 4:1, and most preferably from about 2.75:1 to about 4:1. The alkali metal silicate is present in the composition at from about 1% to about 25%, preferably about 2% to about 20% and most preferably about 4% to about 15% by weight.

Furthermore the compositions preferably contain a diluent in an amount from about 0.1% to about 80%, preferably from about 1% to about 55%, and most preferably from about 2% to about 30% by weight.

The diluent materials useful in the present invention are primarily but not necessarily inert in the composition. For instance a preferred diluent is sodium carbonate which provides alkalinity to the composition thus favouring detergency. The sodium carbonate will also neutralize the acid pyrophosphates present in the slurry or admixed in dried product thereby rendering the latter a more effective builder. Additionally sodium carbonate will control water hardness to a certain extent. On the other hand sodium sulfate also a preferred diluent serves mainly to provide a desirable granule characteristics.

The diluents which are suitable in the present invention include natural and synthetic clays, alkali metal, especially sodium and potassium carbonates, bicarbonates, sesquicarbonates, borates, perborates, sulfates, chlorides, bisulfates, and aluminates. Also useful as a diluent is calcium carbonate.

It is to be understood that the product by process compositions of the present invention may be supplemented by all manner of detergent components, either by including such components in the aqueous slurry to be dried or by admixing such components with the composition of the invention following the drying step.

Other conventional components of detergent compositions may be included in the compositions. These include perhydrate bleaching agents such as perborates and percarbonates, and stabilisers, activators or catalysts therefore; enzymes and stabilizers or protective agents therefore; soil suspending agents; anti-caking agents; agents aiding the processing and spray drying of nonionic detergents if these are used; germicides, oprical brighteners; anti-caking agents; suds controlling agents; colours and perfumes. Some of these components, as is known in the art, are heat sensitive and are best added to the dried product.

Additional amounts of water soluble detergency builders may be added to the detergent compositions of the present invention. Examples of suitable organic detergency builder salts are: (1) water-soluble aminopolycarboxylates, e.g. sodium and potassium ethylenediaminetetraacetates, nitrilotriacetates and N-(2-hydroxyethyl)-nitriiodi-acetates; (2) water-soluble salts of phytic acid, e.g. sodium and potassium phytatos — see U.S. Pat. No. 2,739,942; (3) water-soluble polyphosphonates, including specifically, sodium, potassium and lithium salts of ethane-1-hydroxy-1, 1-diphosphonic acid, sodium, potassium and lithium salts of methylene diphosphonic acid, sodium, potassium and lithium salts of ethylene diphosphonic acid, and sodium, potassium and lithium salts of ethane-1,1,2-triphosphonic acid.

Other examples include the alkali metal salts of ethane-2-carboxy-1, 1-diphosphonic acid, hydroxymethanediphosphonic acid, carbonyldiphosphonic acid, ethane-1-hydroxy-1,1,2-triphosphonic acid, ethane-2-hydroxy-1,1,2-triphosphonic acid, propane-1,1,3,3-tetraphosphonic acid, propane-1,1,2,3-tetraphosphonic acid, and propane-1,2,2,3-tetraphosphonic acid; and (4) water-soluble salts of polycarboxylate polymers and copolymers as described in U.S. Pat. No. 3,308,867.

A useful detergent builder which may be employed in the present invention comprises a water-soluble salt of a polymeric aliphatic polycarboxylic acid having the following structural relationships as to the position of the carboxylate groups and possessing the following prescribed physical characteristics: (a) a minimum molecular weight of about 350 calculated as to the acid form; (b) an equivalent weight of about 50 to about 80 calculated as to acid forms; (c) at least 45 mole percent of the monomeric species having at least two carboxyl radicals separated from each other by not more than two carbon atoms; (d) the site of attachment of the polymer chain of any carboxyl-containing radical being separated by not more than three carbon atoms along the polymer chain from the site of attachment of the next carboxyl-containing radical. Specific examples of the above-described builders include polymers of itaconic acid, aconitic acid, maleic acid, mesaconic acid, fumaric acid, methylene malonic acid and citraconic acid and copolymers with themselves.

In addition, other builders which can be used satisfactorily include water-soluble salts of mellitic acid, citric acid, pyromellitic acid, benzene pentacarboxylic acid, oxydiacetic acid, carboxymethyloxysuccinic acid, and oxydisuccinic acid.

The detergent compositions of this invention preferably contain the water-soluble detergents in a ratio to the total builder present in a weight ratio of from about 10:1 to about 1:10, preferably from about 3:1 to about 1:3. The amount of additional builder in the detergent compositions of the present invention is from about 5% to about 50%, preferably from about 10% to about 25%. These additional builders may be dried with the aqueous slurry or admixed with the dried product of the slurry. If desired the additional builder can be the diluent material and thereby added to the slurry to be dried.

Certain zeolites or alumino silicates when dried with the components of the slurry enhance the function of the silicate of the slurry and add building capacity in that the alumino silicates sequester calcium hardness. When admixed with the dried product of the slurry the alumino silicates function as a cobuilder to the pyrophosphates. One such alumino silicate which is useful in the compositions of the invention is an amorphous water-insoluble hydrated compound of the formula $Na_x(xA10_2 YSiO_2)$, wherein $x$ is an integer of from 1 to 1.2 and $y$ is 1, said amorphous material being further characterized by a $Mg^{++}$ exchange capacity of from about 50 mg eq. $CaCO_3$/g to about 150 mg eq. $CaCO_3$/g. This ion exchange builder is more fully described in Ireland published application No. 1505/74 to B. H. Gedge et al, filed July 15, 1974, herein incorporated by reference.

A second water-insoluble synthetic aluminosilicate ion exchange material useful herein has the formula $Na_z[(A10_2)_z.(SiO_2)_y]\ xH_2O$, wherein z and y are integers of at least 6; the molar ratio of z to y is in the range from 1.0 to about 0.5, and x is an integer from about 15 to about 264; said aluminosilicate ion exchange material having a particle size diameter from about 0.1 micron to about 100 microns, preferably to about 15 microns; a calcium ion exchange capacity of at least about 200 mg eq./g; and a calcium ion exchange rate of at least about 2 grains/gallon/minute/grams. Such materials are further described in Belgian patent 814,874. The above described aluminosilicates are employed at levels of from about 1% to about 40% preferably about 5% to about 15% by weight.

The builder compositions of the invention may be prepared in any suitable way, for instance by mixing phosphates in suitable proportions.

The detergent compositions may be solids, liquids or pastes, but are preferably granular solids. They may be manufactured by any effective method. However, so far as we known, it is not possible to prepare them by methods which involve heat drying, such as spray drying, the phosphates as this would cause enough reversion of the pyro- and/or tripolyphosphate components to produce too much orthophosphate. Thus, it is preferred to mix the phosphates in particulate form, for instance crystalline or ground, with the remainder of the composition. Obviously, sufficiently pure grades, in respect of orthophosphate content, must be used. For making granular products it is preferred to make spray dried granules comprising some or all of the non-heat-sensitive components of the composition. These may be mixed with the phosphates, and, for instance, the perhydrates if these are to be present. The spray dried part of the compositions can be prepared by any methods known in the art. However, to obtain the best possible performance from a limited proportion of phosphatic builder, the detergent compositions are preferably prepared by the process of forming an aqueous slurry comprising the alkali metal silicate and detergent, and the diluent. The slurry so formed is then dried either in a single step or a series of steps to a moisture content not exceeding about 5% by weight. Preferably, the moisture content of the product immediately following the drying operation will contain moisture at a level of from about 0.1% to about 3%, most preferably from about 0.4% to about 2% by weight.

The statement that the moisture content should be determined immediately following the last drying step is necessary as the product may be allowed to rehydrate to higher moisture levels without substantial performance loss. Thus while the product may be dried to a moisture content of 2% by weight of the total solids present, that product may be allowed to hydrate or take on water substantially in excess of the limits expressed above. Apparently the manner in which the moisture is distributed or held throughout the dried product is more important than the total moisture content of the product during its storage life. Another explanation of the product performance may be that the dried product when rehydrated does not revert to its original composition.

The lower limit on the moisture content of the dried product will be determined by the economics involved in that the more the granule is dried the more costly the drying operation and that charring may result from the oxidation of the organic components if the drying temperature is too high.

The slurry may be dried to a solid product of the requisite moisture content by any convenient means. The drying preferably is accomplished in a single step but may be done in a series of steps. Such drying techniques include for example by agglomeration such as is described in U.S. Pat. No. 2,895,916 herein incorporated by reference. Other methods of drying the compositions of the present invention include freeze drying, drum drying, and oven drying. Preferably, however, the drying to a solid is carried out as a single operation in spray-drying towers such as those described in U.S. Pats. Nos. 3,629,951 and 3,629,955, both of which were issued to Robert P. Davis et al, Dec. 28, 1971, both of which are incorporated herein be reference.

Preferably the preparation of the detergent composition comprises the steps of adding the alkali metal silicate, the detergent, and diluent as well as other compatible ingredients, to an aqueous slurry and thoroughly mixing (crutching) the composition. The thoroughly mixed slurry is then dried such as by the previously mentioned spray-drying operation. Where agglomeration or freeze drying is used it may be necessary to further dry product down to the requisite moisture content by additional steps such as oven drying. The product of the present invention is desirably in granular form. Thus if the product is formed in large irregular chunks it is ground to form the desired size granules. The products may be formed into detergent bars as described in U.S. Pat. No. 3,178,370 issued Apr. 13, 1965 and British Pat. No. 1,064,414 issued Apr. 5, 1967 both to Okenfuss herein incorporated by reference.

Granular products in the present invention are preferably prepared by spray drying. The spray-drying operation can be carried out in countercurrent or concurrent drying towers, preferably in countercurrent towers. In it simplest aspect the products of the present invention are spray dried by pumping the slurry which has been crutched to the spray-drying tower where the slurry is fed through a series of atomizing nozzles in a direction opposite to the flow of the hot drying gases. The temperature of the hot air mixture should be in the range of from about 150° to about 1500° F, preferably from about 200° to about 1000° F, and most preferably from about 220° to about 700° F.

The temperatures range within which the granules of the present invention reach is from about 120° to about 300° F, preferably from about 140° to about 275° F, and most preferably from about 150° to about 250° F.

When a multilevel spray-drying apparatus is employed such as described in the Davis et al patent, previously incorporated herein be reference, the product is suitably spray dried with the remaining conditions listed therein.

The detergent composition prepared in accordance with the present invention is preferably used in solid form product, preferably a granule. However, the respective products can be ground to preferably a colloidal size and suspended in an appropriate medium such as water and packaged as a liquid composition.

It may be advantageous to mix the phosphates with the dried granules in the presence of a binding agent, such as a nonionic surfactant, gum or the like, so that they are caused to adhere to the surface of the spray dried granules.

The following compositions were prepared:

| Composition | A | B | C | D | E |
|---|---|---|---|---|---|
| Sodium dodecylbenzene sulphonate | 8.0 | 8.0 | 8.0 | 8.0 | 8.0 |
| Nonionic surfactant | 3.0 | 3.0 | 3.0 | 3.0 | 3.0 |
| Fatty Acid | 3.5 | 3.5 | 3.5 | 3.5 | 3.5 |
| Sodium tripolyphosphate | 26.0 | — | 1.6 | 1.6 | 1.6 |
| Sodium pyrophosphate | 5.0* | 16 | 14.4 | 14.3 | 14.0 |
| Sodium orthophosphate | 1.0* | 0.06 | 0.05 | 0.14 | 0.4 |
| Sodium silicate (solids | | | | | |

-continued

| Composition | A | B | C | D | E |
|---|---|---|---|---|---|
| $SiO_2$:$Na_2O$ 1.6:1) | 7.0 | 7.0 | 7.0 | 7.0 | 7.0 |
| Sodium perobrate | 25.0 | 25.0 | 25.0 | 25.0 | 25.0 |
| Sodium sulphate | 12.0 | 28.0 | 28.0 | 28.0 | 28.0 |
| Minor components | 3.5 | 3.5 | 3.5 | 3.5 | 3.5 |
| Moisture | 6.0 | 6.0 | 6.0 | 6.0 | 6.0 |

*These values are approximate, representing the products of about 20% reversion during spray drying of the 32% tripolyphosphate originally added.

Composition A was a spray dried granular composition, with sodium perborate dry mixed.

Composition C is an accord with the invention; the other compositions are comparative.

Compositions B to E were made by dry mixing the phosphates, as purchased (B and C) and with added orthophosphate (D and E), with granular products representing the remaining components. All the product had substantially equal cleaning properties. Their whiteness maintenance performance was measured as follows:

Swatches of white cotton terry cloth were washed in a launderometer in 18° H (258 ppm as $CaCO_3$) water containing an artificial soil consisting of

| | |
|---|---|
| Air Filter Soil | 200 ppm |
| Clay | 200 ppm |
| Lipid | 100 ppm |

using the above compositions at the concentrations stated below.

The test solutions and swatches were charged into the launderometer pots at 20° C, and heated during the wash cycle of the machine to 95° C during 75 minutes. The swatches were removed, rinsed in 18° H water and dried; for a single cycle test their reflectance was measured, for a double cycle test they were washed again in fresh soil-containing wash liquor, rinsed and dried and their reflectance measured. The whiteness maintenance values were the reflectance of the washed swatches recorded as a percentage of the initial reflectance of the swatches before treatment.

| Test 1 | Two Cycles | | |
|---|---|---|---|
| Values for final reflectance as a percentage of initial reflectance were : | | | |
| Composition | Concentration (% by weight in wash liquor) | | |
| | 0.4 | 0.6 | 0.8 |
| A | 95 | 95 | 93 |
| B | 83 | 80 | 86 |
| C | 93 | 90 | 88 |
| Test 2 | Single cycle | | |
| Composition | Concentration (% by weight in wash liquor) | | |
| | 0.4 | 0.6 | 0.8 |
| A | 97 | 97 | 96 |
| B | 89 | 90 | 88 |
| C | 92 | 93 | 94 |
| D | 89 | 87 | 87 |
| E | 86 | 84 | 85 |

The random error of the values is about ± 1 units percent.

What is claimed is:

1. A detergent composition consisting essentially of:
(a) from about 1% to about 50% by weight of the composition of an organic surfactant selected from the group consisting of water soluble anionic, nonionic, ampholytic and zwitterionic surfactants and mixtures thereof; and
(b) from about 5% to about 60% by weight of the composition of a detergent builder consisting of a mixture of water soluble alkali metal phosphates selected from the group consisting of orthophosphates, pyrophosphates and tripolyphosphates, wherein the amount of tripolyphosphate lies in the range from about 1% to about 15% by weight of the phosphate mixture and wherein the amount of orthophosphates in the phosphate mixture is less than about 1% by weight of the phosphate mixture.

2. A detergent composition according to claim 1 wherein the amount of organic surfactant in the composition is from about 5% to about 40% by weight of the composition and wherein the amount of detergency builder is from about 12% to about 45% by weight of the composition.

3. A detergent composition according to claim 1 wherein the amount of tripolyphosphate in the phosphate mixture lies in the range from about 5% to about 12% by weight of the phosphate mixture and wherein the amount of orthophosphates is not more than about 0.5% by weight of the phosphate mixture.

4. A detergent composition according to claim 1 wherein the phosphate builder mixture in crystalline or ground crystalline form is incorporated in the composition without being subjected to heat drying.

5. A detergent composition according to claim 1 wherein the anionic surfactant is selected from the group consisting of alkali metal, ammonium and substituted ammonium $C_9$–$C_{15}$ linear and branched alkyl benzene sulphonates, $C_8$–$C_{18}$ alkyl sulphates, $C_8$–$C_{24}$ alkyl ether sulphates containing from 1 to about 30 moles of ethylene oxide, α-sulphocarboxylates contains from about 6 to about 20 carbon atoms in the fatty acid group and esters thereof having from about 1 to about 14 carbon atoms in the alcohol radical, and mixtures thereof.

6. A detergent composition, consisting essentially of:
(a) from about 1% to about 50% by weight of the composition of a water soluble organic surfactant selected from the group consisting of anionic, nonionic, ampholytic and zwitterionic surfactants and mixtures thereof;
(b) from about 5% to about 60% by weight of the composition of a detergency builder consisting of a mixture of water soluble alkali metal phosphates selected from the group consisting of orthophosphates, pyrophosphates and tripolyphosphates, wherein the amount of tripolyphosphate in the phosphate mixture lies in the range from about 1% to about 15% by weight of the phosphate mixture and wherein the amount of orthophosphate in the phosphate mixture is less than about 1% by weight of the phosphate mixture; and
(c) from about 1% to about 25% by weight of the composition of an alkali metal silicate having the formula $SiO_2$:$M_2O$ wherein the $SiO_2$:$M_2O$ weight ratio is from about 1.6:1 to about 4:1 and M is an alkali metal.

7. A detergent composition according to claim 6 wherein the weight ratio of $SiO_2$:$M_2O$ is from about 2.4:1 to about 4:1.

8. A detergent composition according to claim 6 wherein the amount of alkali metal silicate present lies in the range from about 2% to about 20% by weight of the composition.

9. A composition according to claim 6 wherein the dried granules have a moisture content not exceeding 5% by weight.

* * * * *